US009347180B2

(12) United States Patent
Silva et al.

(10) Patent No.: US 9,347,180 B2
(45) Date of Patent: May 24, 2016

(54) DEVICE AND METHOD FOR PRODUCING A MATERIAL WEB

(71) Applicant: Voith Patent GmbH, Heidenheim (DE)

(72) Inventors: Luiz Carlos Silva, Campo Limpo SP (BR); Thomas Scherb, Sao Paulo-SP (BR); Daniel Schoeps, Sao Paulo (BR); Dalcio Chiaranda, Sao Paulo (BR); Daniela Reis, Sao Paulo-SP (BR)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 14/629,973

(22) Filed: Feb. 24, 2015

(65) Prior Publication Data

US 2015/0167242 A1 Jun. 18, 2015

Related U.S. Application Data

(60) Division of application No. 14/057,488, filed on Oct. 18, 2013, now Pat. No. 9,267,236, which is a continuation of application No. PCT/EP2012/053692, filed on Mar. 5, 2012.

(30) Foreign Application Priority Data

Apr. 18, 2011 (DE) ..... 10 2011 007 568

(51) Int. Cl.

| | |
|---|---|
| ***D21F 7/08*** | (2006.01) |
| ***D21F 3/02*** | (2006.01) |
| ***D21F 3/04*** | (2006.01) |
| ***D21F 11/14*** | (2006.01) |
| ***D21F 1/80*** | (2006.01) |
| ***D21F 1/66*** | (2006.01) |
| ***D21F 3/10*** | (2006.01) |

(52) U.S. Cl.

CPC .. *D21F 7/08* (2013.01); *D21F 1/66* (2013.01); *D21F 1/80* (2013.01); *D21F 3/0209* (2013.01); *D21F 3/029* (2013.01); *D21F 3/0272* (2013.01); *D21F 3/045* (2013.01); *D21F 3/10* (2013.01); *D21F 11/14* (2013.01)

(58) Field of Classification Search

CPC ..... D21F 7/08; D21F 1/66; D21F 3/10; D21F 3/02

USPC ..... 162/210, 358.1–358.5

See application file for complete search history.

(56) References Cited

U.S. PATENT DOCUMENTS

| | | | |
|---|---|---|---|
| 6,701,637 | B2 | 3/2004 | Lindsay et al. |
| 6,908,532 | B2 | 6/2005 | Steiner et al. |
| 7,297,233 | B2 | 11/2007 | Herman et al. |
| 7,927,462 | B2 | 4/2011 | Scherb et al. |
| 8,608,909 | B2 | 12/2013 | Scherb et al. |
| 2002/0152630 | A1 | 10/2002 | Lindsay et al. |
| 2004/0166300 | A1 | 8/2004 | Steiner et al. |
| 2007/0068645 | A1 | 3/2007 | Silva |
| 2008/0210397 | A1 | 9/2008 | Scherb et al. |
| 2012/0061044 | A1 | 3/2012 | Scherb et al. |

FOREIGN PATENT DOCUMENTS

| | | | |
|---|---|---|---|
| EP | 1 518 960 | A1 | 3/2005 |

OTHER PUBLICATIONS

Notice of Transfer of International Research Report and the Written Notice Issued for International Searching Authority or Statement dated May 15, 2012 for International Application No. PCT/EP2012/053692 (11 pages).

*Primary Examiner* — Mark Halpern

(74) *Attorney, Agent, or Firm* — Taylor IP, P.C.

(57) ABSTRACT

The invention relates to a device for dewatering a fibrous web with a press zone which is formed by a mating element with a curved surface and a permeable press belt which wraps at least partially around the curved surface and has a running side and a contact side contacting a second side of the fibrous web. A permeable carrier belt arranged between the mating element and the fibrous web guides the fibrous web through the press zone. The device is configured so a fluid can flow through the press belt, the fibrous web, and the permeable carrier belt at least in a part region of the press zone. The permeable press belt is configured to generate a pressing pressure in the press zone when a tensile stress of at least 20 kN/m is applied and the contact side is adapted to a quality of the fibrous web produced.

14 Claims, 1 Drawing Sheet

DEVICE AND METHOD FOR PRODUCING A MATERIAL WEB

CROSS REFERENCE TO RELATED APPLICATIONS

This is a division of U.S. patent application Ser. No. 14/057,488 entitled "DEVICE AND METHOD FOR PRODUCING A MATERIAL WEB," filed Oct. 18, 2013, which is a continuation of PCT application No. PCT/EP2012/053692, entitled "DEVICE AND METHOD FOR PRODUCING A MATERIAL WEB", filed Mar. 5, 2012, which is incorporated herein by reference.

BACKGROUND OF THE INVENTION

1. Field of the Invention

The present invention relates to a device for dewatering a fibrous web, and, more particularly, to a suction equipped press for removing water from a fibrous web.

2. Description of the Related Art

Presses for removing water from a fibrous web are known in the art. Documents EP 1709239 A2 and EP 1518960 A1 disclose machines for the production of fibrous webs with devices for mechanical dewatering of fibrous webs. The fibrous web is guided between an outside and an inside dewatering belt, and over a suction roll through the press zone. To apply the pressing pressure, an additional belt is provided with high tensile stress inside the loop of the outside dewatering belt. These devices are very complex and expensive. Each of these belts is guided over a plurality of guide rolls. In addition, tension controls, control systems to control the belt travel and conditioning devices are necessary. These belts are also subject to wear and tear, so they need to be replaced from time to time. Each replacement necessarily requires a shutdown of the paper machine. This results in production losses which are reflected in high operating costs. An additional disadvantage of the known devices manifests in the production of tissue webs when a plurality of different paper types are produced on a paper machine. In order to satisfy the different quality requirements of the paper types, at least part of the belts which are in contact with the fibrous web must be adapted to the specific paper, meaning they must be exchanged. The expenditure for this on the known machines is great.

What is needed in the art is a device that can lower operating and investment costs as well as increase the flexibility in the production of different paper types.

SUMMARY OF THE INVENTION

The present invention provides a device for dewatering a fibrous web, in particular a paper, cardboard or tissue web, which includes a press zone formed by a suction equipped mating element which is equipped with a vacuum and has a curved surface and by a permeable press belt which wraps at least partially around the curved surface and which has a running side and a contact side. The fibrous web is guided through the press zone with a first side on a permeable carrier belt and the permeable carrier belt is arranged between the suction equipped mating element and the fibrous web. The device is configured so that a fluid can flow in at least a partial region in a direction of travel of the press zone through the press belt, the fibrous web and the permeable carrier belt in the region of the press zone. The permeable press belt makes direct contact with its contact side with a second side of the fibrous web and is configured so that a tensile stress of at least 20 kN/m can be applied to produce a pressing pressure in the press zone and so that the texture of the contact side is adapted to the quality of the paper which is to be produced.

In an additional embodiment, the configuration of the device is selected so that the pressing pressure in the press zone is in the range of 0.3 bar to 2 bar, and more specifically between 0.4 bar and 1.5 bar.

In another embodiment, the permeable press belt is the only belt on the side of the press zone facing the second side of the fibrous web.

In another embodiment the suction equipped mating element is a suction roll or a suction box. These elements are equipped with a suction zone, at least in a partial region of the press zone to receive the fluid. Viewed in a direction of travel the suction zone may be located at the beginning, within, or at the end of the press zone, or may extend over the entire press zone. The fluid first flows expediently through the permeable press belt, then through the fibrous web and subsequently through the permeable carrier belt. In this case, the fluid which is loaded with water from the fibrous web does not flow through the permeable press belt. Higher dry-content can thereby be achieved in the fibrous web.

The fluid can also flow first through the permeable carrier belt, then the fibrous web and subsequently the permeable press belt. This can be advantageous with select clothing in the production of specific paper qualities.

The permeable carrier belt can be a felt or a woven fabric, for example a coarse fabric to help in structuring the surface of the fibrous web. Such fabrics are known as TAD (through air drying) fabrics.

In an additional embodiment, the permeable press belt includes at least one first woven fabric layer. This woven fabric layer is configured such that it can absorb the high tensile stress that occurs while producing the pressing pressure in the press zone. The first woven fabric layer may, for example, consist of a 5-strand woven fabric with a weaving pattern where the warp threads progress underneath one and over 4 weft threads. The repeat extends therefore over 5 weft threads. This type of weaving pattern produces a very coarse surface on the contact side of the permeable press belt, which is advantageous in producing a fibrous web having large thickness and high specific volume, with a lower dry content increase. This applies in particular to the production of tissue papers. The coarse structure, to some extent, embosses a structure into the surface of the fibrous web. In this case it is advantageous if the permeable carrier belt is a felt. The coarse structure of the permeable press belt produces first regions in the press zone where the fibrous web is pressed to a lesser extent than in other regions. In the first regions the fibrous web is compressed to a lesser extent. Overall this leads to a more voluminous fibrous web having large thickness and high specific volume in the produced fibrous web.

For the production of the permeable press belt, the first woven fabric layer can consist of at least a plurality of weft threads and a plurality of warp threads, and a seam transverse to the direction of movement to connect the two ends of the first woven fabric layer, whereby the warp threads of the respective ends overlap each other in the region of the seam by at least 150 mm, and more specifically 200 mm or more. Thereby seam widths of greater than 300 mm to greater than 400 mm are formed. This enables the fabric with the seam to absorb the tensile stresses necessary for effective dewatering of the fibrous web, or respectively the paper web, without being deformed substantially under tension. The fabric characteristics therefore remain constant over the entire fabric surface. Markings of the seam do not thereby occur in the fibrous web.

Moreover, the permeable press belt can consist solely of the first woven fabric layer and can be used for the production of a fibrous web having a large thickness of 0.14 mm or more, and more specifically 0.15 mm or more, and/or a high specific volume of the fibrous web after mechanical dewatering greater than 6.5 $cm^3/g$, in particular greater than 7 $cm^3/g$. This applies in particular to the production of tissue papers. An additional press nip for additional mechanical dewatering and for transfer of the tissue web to a drying cylinder can be located downstream of the device, whereby the mechanical dewatering is concluded after the transfer. The dry content increase for this embodiment allows a dry content of 45% or greater to be achieved.

In an additional embodiment the permeable press belt further includes a second woven fabric layer which is joined with the first woven fabric layer, whereby the first and the second woven fabric layer have a different thread count and whereby the first woven fabric layer represents a running side and the second woven fabric layer represents a contact side and can be used for a large thickness of 0.13 mm or more, and more specifically 0.14 mm or more, and/or a medium specific volume of the fibrous web after mechanical dewatering of greater than 6 $cm^3/g$, in particular greater than 6.5 $cm^3/g$. The second woven fabric layer can consist of thinner threads than the first woven fabric layer. The second woven fabric layer can also consist of more weft threads and/or more warp threads per centimeter, which means that it has a greater weave density. The dry content increase for this embodiment allows a dry content of 46% or greater to be achieved.

In an additional embodiment, the permeable press belt can consist of a second non-woven layer which is joined with the first woven fabric layer, whereby the first woven fabric layer and the second non-woven layer present a different fineness or coarseness in the surface structure, and the first woven fabric layer represents the running side and the second non-woven layer represents the contact side, and can be used for a high dry content of the fibrous web greater than 47% after mechanical dewatering. The second non-woven layer can consist of individual fibers which are needled onto the first woven fabric layer. This process is known from the production of felts.

The second non-woven layer can include felt fibers which have a fineness of less than 5 dtex, and more specifically 3.3 dtex or less. High dry content and uniform flow through the fibrous web can thereby be possible.

In another embodiment, the permeable press belt can consist of a non-woven belt. The surface structure of the contact side can thereby be produced, for example, during casting of the belt and/or fusing of plastics or other materials and/or through material removing processes, for example through laser or water jet technology. The advantage is in the manufacturability of almost any desired surface structure. The permeability can, for example, be produced during casting of the belt and/or by the material removing process, for example through laser or water jet technology.

The permeable press belt can have a permeability of greater than 20 cfm, in particular greater than 50 cfm.

In another embodiment, a hood to supply the fibrous web with hot fluid is allocated to the press zone inside a loop of the permeable press belt. Viewed in the direction of travel, the hood can be located at the beginning, within, or at the end of the press zone or can extend over the entire press zone. A steam blow pipe or a steam blow box can also be included for heating the fibrous web, more specifically at the beginning of the press zone. The fluid can be hot dry air, steam or moist hot air. The fluid can serve to heat the fibrous web and/or to absorb water from the fibrous web. The fluid can expediently be taken from hood exhaust air, for example from impingement air or a through-air drying device of the paper machine. This can reduce the energy consumption in the production of paper and thereby the operating costs.

An additional embodiment of the invention is a machine for the production of a fibrous web, in particular a paper, cardboard or tissue web with a described device for dewatering a fibrous web, in particular a paper, cardboard or tissue web, with a forming section located upstream from the device and a drying section located downstream from the device. The forming section can be a crescent former, a twin wire former, or a Fourdrinier former. The drying section, where thermal drying takes place, includes at least one drying cylinder. Depending on the application, a plurality of dryer groups consisting of a plurality of dryers is possible.

In the production of a tissue web, the drying section includes a drying cylinder with a drying cylinder hood. The fibrous web, for example tissue web, is guided by the device's permeable carrier belt to and through a press nip which is formed by a suction press roll or a shoe press roll and the drying cylinder, and is transferred to the surface of the drying cylinder to be dried. The drying cylinder can have a diameter of greater than 3 m, and more specifically greater than 4 m.

The invention also relates to a press belt for use in a device for dewatering a fibrous web with a press zone, in particular one that is suction equipped. The press zone is formed by a mating element having a curved surface and by the press belt which wraps at least partially around the curved surface. The press belt is permeable and has a contact side in immediate contact with the fibrous web. The press belt is designed in such a way that a tensile stress of at least 20 kN/m can be applied to produce a pressing pressure in the press zone and that a texture of the contact side is adapted to a quality of the fibrous web which is to be produced.

In an additional embodiment, the permeable press belt includes at least one first woven fabric layer. This woven fabric layer is configured such that it can absorb the high tensile stress that occurs while producing the pressing pressure in the press zone. The woven fabric layer may, for example, consist of a 5-strand woven fabric with a weaving pattern where the warp threads progress underneath one and over 4 weft threads. The repeat extends therefore over 5 weft threads. This type of weaving pattern produces a very coarse surface on the contact side of the permeable press belt, which is advantageous in producing a fibrous web having large thickness and high specific volume, with a lower dry content increase. This applies in particular to the production of tissue papers. The coarse structure, to some extent, embosses a structure into the surface of the fibrous web. In this case it is advantageous if the permeable carrier belt is a felt. The coarse structure of the permeable press belt produces first regions in the press zone where the fibrous web is pressed to a lesser extent than in other regions. In the first regions the fibrous web is compressed to a lesser extent. Overall this leads to a more voluminous fibrous web having a large thickness and high specific volume.

For the production of a press belt, the first woven fabric layer can consist of at least weft threads and warp threads and have a seam transverse to the direction of movement to connect the two ends of the woven fabric layer. The warp threads of the respective ends can overlap each other in the region of the seam by at least 150 mm, more specifically 200 mm or more. Such a configuration allows seam widths of greater than 300 mm to greater than 400 mm to be formed. This enables the fabric with the seam to absorb the tensile stresses necessary for effective dewatering of the fibrous web, or the paper web, without being deformed substantially under tension. The fabric characteristics therefore remain constant over the entire fabric surface and markings of the seam do not occur in the fibrous web.

In another embodiment, the permeable press belt can consist solely of the first woven fabric layer and can be used for the production of a fibrous web having a large thickness of 0.14 mm or more, more specifically 0.15 mm or more, and/or a high specific volume of the fibrous web after mechanical dewatering greater than 6.5 $cm^3/g$, in particular greater than 7 $cm^3/g$.

In another embodiment, the permeable press belt can consist of a second woven fabric layer which is joined with the first woven fabric layer. The first woven fabric layer and the second woven fabric layer can have a different thread count. The first woven fabric layer represents the running side and the second woven fabric layer represents the contact side and can be used for a large thickness of 0.13 mm or more, more specifically 0.14 mm or more, and/or a medium specific volume of the fibrous web after mechanical dewatering of greater than 6 $cm^3/g$, in particular greater than 6.5 $cm^3/g$. The second woven fabric layer can consist of thinner threads than the first woven fabric layer. The second woven fabric layer can consist of more weft threads and/or more warp threads per centimeter, which means that it has a greater weave density. The dry content increase for this embodiment can be 46% or greater.

In another embodiment, the permeable press belt can consist of a second non-woven layer which is joined with the first woven fabric layer. The first woven fabric layer and the second non-woven layer can have a different fineness or coarseness in the surface structure, and the first woven fabric layer represents the running side and the second layer the contact side, and can be used for a high dry content of the fibrous web of greater than 47% after mechanical dewatering. The second non-woven layer can consist of individual fibers which are needled onto the first woven fabric layer. This process is known from the production of felts.

The second non-woven layer can include felt fibers which have a fineness of less than 5 dtex, and more specifically 3.3 dtex or less. High dry content and uniform flow through the fibrous web can thereby be achieved.

In another embodiment, a permeable press belt can consist of a non-woven belt. The surface structure of the contact side can be produced during casting of the belt, fusing of plastics or other materials, and/or through material removing processes, for example through laser or water jet technology. The advantage is in the manufacturability of almost any desired surface structure. The permeability can, for example, be produced during casting of the belt and/or by the material removing process, for example through laser or water jet technology.

The permeable press belt can have a permeability of greater than 20 cfm, in particular greater than 50 cfm.

The present invention also provides a method for dewatering a fibrous web. The method includes providing a device for dewatering a fibrous web which includes a press zone having a suction equipped mating element with a curved surface and a permeable press belt. The permeable press belt has a running side and a contact side making direct contact with a second side of the fibrous web. The contact side has a texture adaptable to a quality of the fibrous web which is to be produced. The permeable press belt wraps at least partially around the curved surface of the suction equipped mating element and is configured such that a tensile stress applied to the permeable press belt produces a pressing pressure in the press zone. The device also includes a permeable carrier belt arranged between the suction equipped mating element and the fibrous web with a first side of the fibrous web lying on the permeable carrier belt. The permeable carrier belt guides the fibrous web through the press zone. The permeable press belt, fibrous web, and permeable carrier belt are configured to allow a fluid to flow therethrough in at least a partial region of the press zone. The method further includes the steps of applying a tensile stress of at least 20 kN/m to the permeable press belt; adapting the texture of the contact side to the quality of the fibrous web; and utilizing the device to dewater the fibrous web.

An advantage of the present invention is the reduction of the number of belts in the dewatering device. Operating and investment costs are hereby reduced through the lowered machine-technological complexity and through easy and quick changeover of the press belt in the device. This simple construction also increases the flexibility of the configuration of the device for dewatering of the web. It is thereby worthwhile for small production volumes of a specific paper type to adapt the belts which contact the fibrous web to the quality requirements of the paper type to be produced by replacing them.

The advantage of this solution is found in the reduction of the number of belts in the dewatering device. Operating and investment costs are hereby reduced, on the one hand through the lower machine-technological complexity and on the other hand through easy and quick changeover of the press belt in the device. This simple construction also increases the flexibility of the configuration of the device for dewatering of the web. It is thereby worthwhile also for small production volumes of a specific paper type to adapt the belts which contact the fibrous web to the quality requirements of the paper type to be produced by replacing them. Optimum qualities can therefore be produced.

Another advantage is the increases in thickness and dry content achieved by the device are considerable. On a standard tissue machine which has only one press nip formed by a suction press roller and the Yankee drying cylinder, a thickness of only 0.125 mm and a dry content of only approximately 41.5% can be achieved.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1:
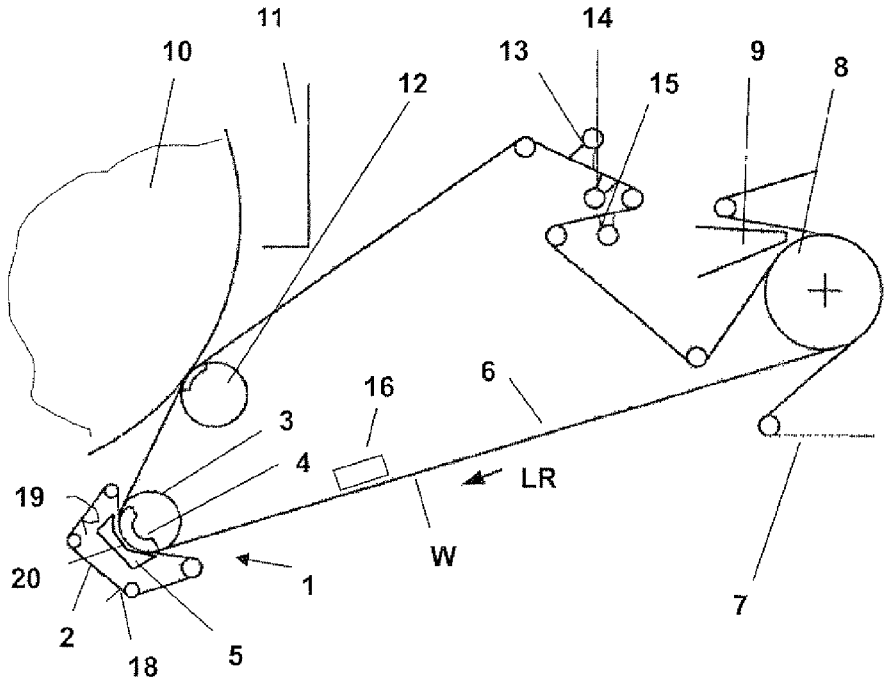
FIG. 1 is a schematic view of an embodiment of the present invention.

Referring now to the drawings, and more particularly to FIG. 1, there is shown a machine for the production of a fibrous web W, in this case a tissue web W, in the embodiment of a crescent former which generally includes a forming roll 8 around which a permeable carrier belt 6 and an outside forming fabric 7 wrap. The permeable carrier belt 6 is a felt or felt belt. The outside forming fabric 7 is a woven fabric belt. The permeable carrier belt 6 and outside forming fabric 7 form a nip at the beginning of the wrap where a headbox 9 is located for bringing a fibrous stock suspension from which fibrous web W is formed, into the nip. Part of the water is removed from the fibrous stock suspension in the wrap region. After this initial dewatering of the fibrous stock suspension, the outer forming fabric 7 is directed away from the formed but still moist fibrous web W at the end of the wrap region. After initial dewatering, the fibrous web W has a dry content of greater than 10%.

The fibrous web W is subsequently guided by the permeable carrier belt 6 to a device 1 for further dewatering. Between the forming roll 8 and the device 1, a suction element 16 is arranged inside a loop of the permeable carrier belt 6 to increase the dry content to 20%. The device 1 includes a press zone 20 which is formed by a suction equipped mating element 3 and a permeable press belt 2. The fibrous web W, laying with a first side on the permeable carrier belt 6, is guided through the press zone 20 and dewatered. The dewatering pressure is produced mainly by a permeable press belt 2 which is tensioned between 20 kN/m and 30 kN/m. The permeable press belt 2 wraps at least partially around a curved surface of the suction equipped mating element 3 and includes a running side 19 and a contact side 18. The permeable press belt 2 makes contact with the fibrous web W on the contact side 18 and is thereby in immediate contact with the fibrous web W. In this embodiment, the permeable press belt 2 is the only belt on the side of the press zone 20 facing a second side of the fibrous web W.

The permeable press belt 2 includes at least one first woven fabric layer. The first woven fabric layer is configured such that it can absorb the high tensile stress that occurs while producing the pressing pressure in the press zone 20. The first woven fabric layer can include a plurality of warp threads and a plurality of weft threads. The first woven fabric layer can, for example, consist of a 5-strand woven fabric with a weaving pattern where the warp threads progress underneath one and over 4 weft threads. The repeat extends therefore over 5 weft threads. This type of weaving pattern produces a very coarse surface on the contact side 18 of the permeable press belt 2, which is advantageous in producing a fibrous web W having a high specific volume and large thickness of 0.14 mm or more.

The coarse structure, to some extent, embosses a structure into the surface of the fibrous web W. The coarse structure of the permeable press belt 2 produces first regions in the press zone 20 where the fibrous web W is pressed to a lesser extent than in other regions. In the first regions, fibrous web W is compressed to a lesser extent. Overall this leads to a higher specific volume and large thickness in the produced fibrous web W. The first and only woven fabric layer of the permeable press belt 2 consists of weft threads and warp threads, and has a seam transverse to a direction of movement LR to connect the two ends of the woven fabric layer, whereby the warp threads overlap each other at the respective ends in the region of the seam by 200 mm or more. Thereby seam widths of greater than 400 mm are formed. This enables the fabric with the seam to absorb the tensile stresses necessary for effective dewatering of the fibrous web W, or the paper web W, without being deformed substantially under tension. The fabric characteristics therefore remain constant over the entire fabric surface. Markings of the seam therefore do not occur in the fibrous web W.

In the loop of the permeable press belt 2, a hood 5 is provided in the region of the press zone 20 to heat the fibrous web W with moist hot air. The moist, hot air flows first through the permeable press belt 2, then through the fibrous web W and subsequently through the permeable carrier belt 6, before it is discharged over a suction zone 4 which extends over the entire press zone 20 through the suction equipped mating element 3. To lower energy costs, the moist, hot air is taken from the exhaust of a drying cylinder hood 11 which is arranged over a drying cylinder 10. The drying cylinder 10, which can be a Yankee-cylinder 10 with a diameter of 4.5 m, is located downstream from the device 1. The fibrous web W is guided by the permeable carrier belt 6 to and through a press nip, which is formed by a shoe press roller 12 and the drying cylinder 10, and transferred to the drying cylinder 10 surface. After the transfer, the mechanical dewatering of the fibrous web is complete and thermal drying begins through contact with the drying cylinder 10 surface and through impingement air drying with hot dry air in the region of the drying cylinder hood 11. After leaving the press nip, the fibrous web W has a specific volume greater than 6.5 $cm^3/g$ and/or a large thickness of 0.14 mm or more. After the press nip, the permeable carrier belt 6 is led back to the forming roll 8 over three alternately arranged suction devices 13, 14, 15 for conditioning and cleaning The device 1 is arranged as near as possible to the press nip. The length of the second side of the tissue web W which is not covered can be less than 5 m in order to keep a cool-down of the tissue web W to a minimum or to avoid it.

Figure 2:
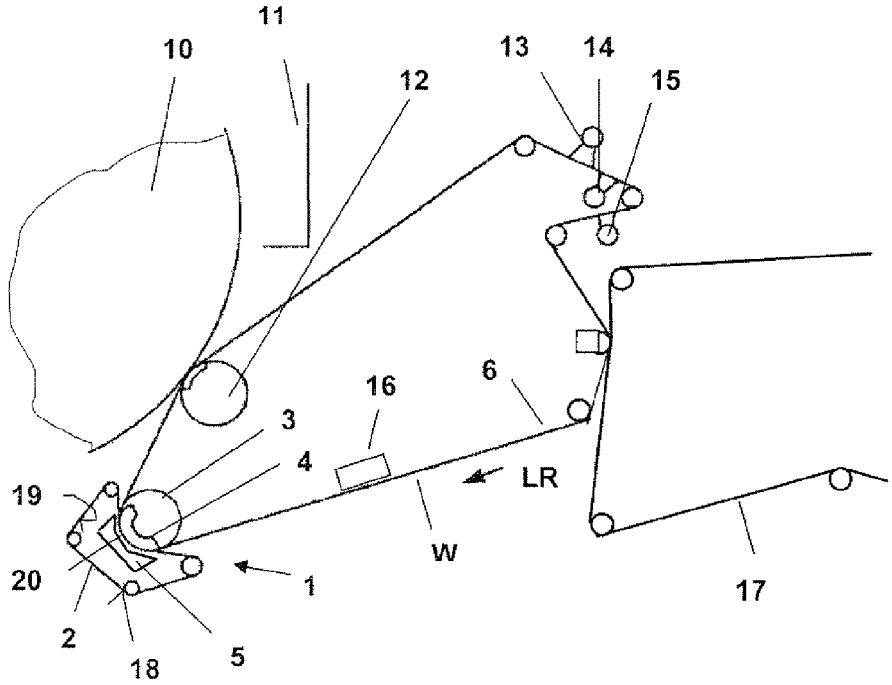
FIG. 2 is a schematic view of another embodiment of the present invention.

FIG. 2 illustrates another embodiment of a tissue machine with a twin-wire former or Fourdrinier, with respective elements given the same reference symbols as used in FIG. 1. In the Fourdrinier embodiment, the fibrous web W is formed on an inside forming fabric 17 and transferred to the permeable carrier belt 6 with the assistance of a suction device. When using a twin-wire former, the tissue web W is dewatered between two woven fabrics and is subsequently guided by the inside forming fabric 17 to the transfer location to the permeable carrier belt 6. The arrangement in FIG. 2 is otherwise the same as the arrangement shown in FIG. 1.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A device for dewatering a fibrous web, comprising:

a suction equipped mating element having a curved surface; and a permeable press belt having a running side and a contact side making direct contact with a second side of the fibrous web and having a texture adapted to a quality of the fibrous web which is to be produced, said permeable press belt and said suction equipped mating element defining a press zone therebetween, said permeable press belt wrapping at least partially around said curved surface and being configured such that a tensile stress of at least 20 kN/m can be applied to said permeable press belt to produce a pressing pressure in said press zone, said permeable press belt comprising at least a first woven fabric layer; and a permeable carrier belt arranged between said suction equipped mating element and the fibrous web with a first side of the fibrous web lying on said permeable carrier belt, said permeable carrier belt guiding the fibrous web through said press zone and said permeable press belt, the fibrous web, and said permeable carrier belt configured to allow a fluid to flow therethrough in at least a partial region of said press zone.

2. The device of claim 1, wherein said permeable press belt is the only belt on a side of said press zone facing the second side of the fibrous web.

3. The device of claim 2, wherein said suction equipped mating element is one of a suction roll and a suction box.

4. The device of claim 3, wherein the fluid flows first through said permeable press belt, then through the fibrous web, and subsequently through said permeable carrier belt.

5. The device of claim 3, wherein the fluid flows first through said permeable carrier belt, then through the fibrous web, and subsequently through said permeable press belt.

6. The device of claim 1, wherein said first woven fabric layer comprises at least a plurality of weft threads and a plurality of warp threads, and has a seam transverse to a direction of movement to connect two ends of said woven fabric layer, said plurality of warp threads of the respective ends overlapping each other in a region of said seam by at least 150 mm.

7. The device of claim 6, wherein said permeable press belt further comprises a second woven fabric layer having a different thread count than said first woven fabric layer joined with said first woven fabric layer, said first woven fabric layer configured as said running side and said second woven fabric layer configured as said contact side such that the fibrous web produced has a large thickness of at least 0.13 mm after mechanical dewatering.

8. The device of claim 6, wherein said permeable press belt further comprises a second non-woven layer having a different fineness than said first woven fabric layer joined with said first woven fabric layer, said first woven fabric layer configured as said running side and said second non-woven layer configured as said contact side such that the fibrous web produced has a dry content of at least 48% after mechanical dewatering.

9. The device of claim 8, wherein said second non-woven layer comprises felt fibers having a fineness less than 5 dtex.

10. The device of claim 9, wherein said permeable press belt has a permeability greater than 20 cfm.

11. The device of claim 10, further comprising a hood to supply the fibrous web with a hot fluid that is allocated to said press zone inside a loop of said permeable press belt.

12. The device of claim 11, further comprising a forming section located upstream from said device and a drying section located downstream from said device.

13. The device of claim 1, wherein said permeable press belt consists solely of said first woven fabric layer and is configured to give the fibrous web at least one of a large thickness of at least 0.14 mm and a high specific volume after mechanical dewatering.

14. The device of claim 1, wherein said permeable press belt is configured such that a tensile stress of at least 30 kN/m can be applied to said permeable press belt to produce said pressing pressure in said press zone.

* * * * *